US006856298B1

(12) United States Patent
Huan

(10) Patent No.: US 6,856,298 B1
(45) Date of Patent: Feb. 15, 2005

(54) DUAL BAND LINEAR ANTENNA ARRAY

(75) Inventor: Jin He Huan, Taipei (TW)

(73) Assignee: Golden Bridge Electech Inc., Taipei (TW)

( * ) Notice: Subject to any disclaimer, the term of this patent is extended or adjusted under 35 U.S.C. 154(b) by 3 days.

(21) Appl. No.: 10/642,242

(22) Filed: Aug. 18, 2003

(51) Int. Cl.[7] ..... H01Q 21/00
(52) U.S. Cl. ..... 343/810; 343/795; 343/893
(58) Field of Search ..... 343/702, 795, 343/810, 890, 893

(56) References Cited

U.S. PATENT DOCUMENTS 6,529,172 B2 * 3/2003 Zimmerman ..... 343/797
2001/0035844 A1 * 11/2001 Reece et al. ..... 343/810
2004/0075615 A1 * 4/2004 Engargiola et al. ..... 343/810
2004/0140942 A1 * 7/2004 Gottl ..... 343/810

* cited by examiner

*Primary Examiner*—Tan Ho

(57) ABSTRACT

A dual band linear antenna array, having a set of radiator constructed by four elongate metal plates. The metal plates are arranged to form a rectangular array. By serially connecting to a signal feed terminal, the roots of the metal plates are connected to a copper tube via a coaxial cable external conductor (ground signal). One pair of the metal plates has the same length, which is about one quarter wavelength of the high-frequency electric wave received thereby and transmitted therefrom. The other pair of the metal plates has longer length at about one quarter wavelength of a low-frequency electric wave received thereby and transmitted therefrom. Thereby, an array of dual band antenna is obtained to achieve omni-directional reception and transmission of radiation.

14 Claims, 4 Drawing Sheets

DUAL BAND LINEAR ANTENNA ARRAY

BACKGROUND OF THE INVENTION

The present invention relates generally to a dual band linear antenna developed from the concepts of J-type antenna and array-type antenna to provide dual band wireless communication, and more particularly, to a linear dipole antenna array.

The popularity of portable electric products has speeded up the development of wireless communication technique in recent years. The wireless communication device normally requires two bands to perform signal transmission and reception. For example, for the very popular wireless local area network (WLAND), according to the specification of IEEE 802.11a, b and g, the band width of the communication frequency between the access point (AP) and the WLAND card ranges at 2.4–2.5 GHz and 4.9–5.8 GHz. Therefore, a dual band antenna has to be used for the dual band device to provide the optimal effect.

In the aforementioned wireless local area network, an internal antenna is often adapted to minimize the size and provides aesthetic effect of the WLAN card, while an external antenna is typically used for the access point. FIG. 1 shows a dual band antenna commonly used in the access point. As shown in FIG. 1, a linear copper foil A1 is placed on a printed circuit board A to form a radiator, so as to form a planar antenna. However, such planar antenna has higher directivity. That is, a fan-shaped area outlined by two sides of planar orthogonal line has better transmission and reception, while the reception and transmission are poorer along the extension of the plane (that is, the area parallel to the plane). Further, being blocked by the material of the board, the radiation of the rear surface of the circuit board that does not have the copper foil is affected. Other approaches such as adhering two such planar antennas together, or placing copper foil on both sides of the circuit board to form two set of planar antennas is also proposed to improve reception and transmission of electric wave radiation. None of these approaches provides a 360° omni-directional radiation. Therefore, the improvement of radiation along the area parallel to the circuit board is still insignificant. A dead angle still exits for reception and transmission of electric wave.

BRIEF SUMMARY OF THE INVENTION

The present invention provides a dual band linear antennal array which provides omni-directional reception and transmission of electric wave without dead angle. The dual band linear antennal array can be fabricated by simple process with low cost.

The dual band linear antenna array provided by the present invention comprises four elongate metal plates to form a set of radiators. The metal plates are arranged to form a rectangular array. One pair of the metal plates has the same height, which is one quarter wavelength of the high-frequency electric wave received thereby and transmitted therefrom. The other pair of the metal plates has a longer height, which is one quarter wavelength of the low-frequency electric wave received thereby and transmitted therefrom.

BRIEF DESCRIPTION OF THE DRAWINGS

These, as well as other features of the present invention, will become more apparent-upon reference to the drawings wherein.

DETAILED DESCRIPTION OF THE INVENTION

Figure 1:
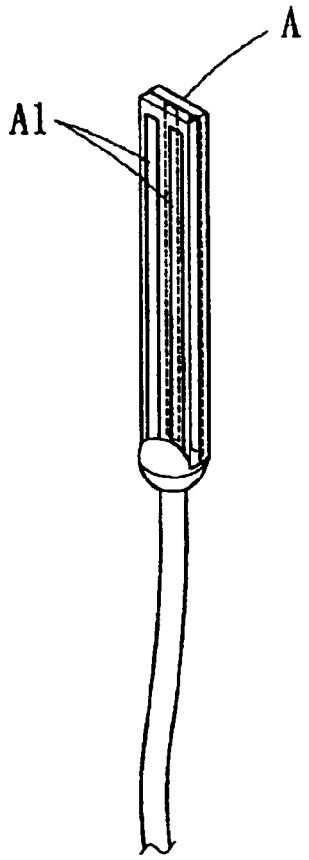
FIG. 1 PRIOR ART
FIG. 1 shows the perspective view of a conventional dual band planar antenna.
Figure 2:
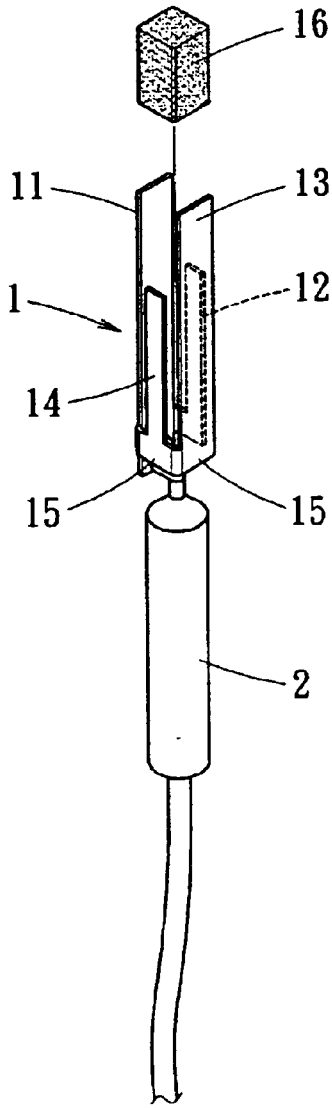
FIG. 2 shows the exploded view of a dual band linear antenna array in a first embodiment of the present invention.
Figure 3:
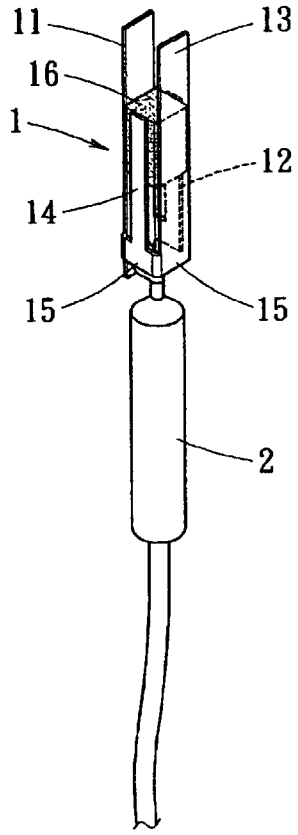
FIG. 3 shows the perspective view of FIG. 2.
Figure 4:
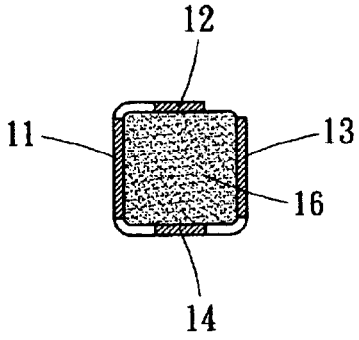
FIG. 4 shows the exploded view of a dual band linear antenna array in a second embodiment of the present invention.

Referring to FIGS. 2, 3 and 4, a perspective view and a top view of a first embodiment of the present invention are provided. As shown, a radiator 1 is constructed by four elongate metal plates 11, 12, 13 and 14. The metal plates 11, 12, 13 and 14 include non-insulated bare iron or copper plates and arranged to form a rectangular array. A connecting board 15 is used to connect the roots of the metal plates 11, 12, 13 and 14. The radiator further comprises a positioning member 16 inserted between the top portions of the metal plates 11, 12, 13 and 14. Preferably, the positioning member 16 includes a cuboid made of insulation material such as elastic foam or rubber. The dimension of the positioning device 16 allows the top portions of the metal plates 11, 12, 13 and 14 to be spaced from each other in the same manner as the roots of the metal plates 11, 12, 13 and 14. The roots of the conductors 11, 12, 13 and 14 are then serially connected to a signal feed terminal. By a coaxial cable external conductor (ground signal), the metal plates 11, 12, 13 and 14 are connected to a copper tube 2. The of opposing metal plates 12 and 14 is at the same height. In this embodiment, the length of the opposing metal plates 11 and 13 is longer than that of the metal plates 12 and 14. The length of the metal plates 11 and 13 is preferably one quarter wavelength of a low-frequency electric wave to be received and transmitted, while the length of the metal plates 12 and 14 is preferably one quarter wavelength of the high-frequency electric wave to be transmitted and received. For example, when the low frequency electric wave is 2.4–2.5 GHz and the high frequency electric wave is 4.9–5.8 GHz, the length of the metal plates 11 and 13 is about 2.2 cm, and the length of the metal plates 12 and 14 is about 1.2 cm. The specific lengths of the metal plates 11, 12, 13 and 14 depend on the wavelength of the electric wave to be received thereby and transmitted therefrom. The material for fabricating the metal plates 11, 12, 13, and 14, and the diameters of and the space between the metal plates 11, 12, 13 and 14 may also vary the lengths thereof. By the present invention, a dual band antenna with an omni-directional radiation is obtained. As multiple linear antennas are used to assemble the antenna array, no dead angle exists, and the omni-directional radiation is achieved. Therefore, the radiation field and gain of the antenna are greatly enhanced.

Figure 5:
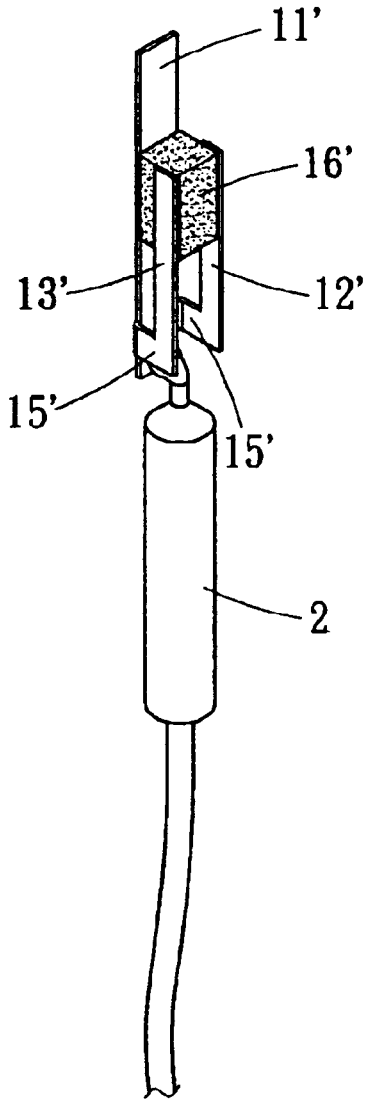
FIG. 5 shows the perspective view of FIG. 4.

FIG. 5 shows the perspective view of the second embodiment of the present invention. In this embodiment, three elongate metal plates 11', 12' and 13' are arranged to form an open rectangular array. As shown, the metal plate 11' is longer than the metal plates 12' and 13'. A connecting board 15' is used to connect the roots of the metal plates 11', 12' and 13', and a positioning member 16' is clipped between the top portions of the metal plates 11', 12' and 13'.

According to the above, the present invention uses the concept of J-type antenna and array-type antenna to design an omni-directional radiation field and an improved gain with relatively low cost and simple fabrication process.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A dual band linear antenna array, comprising four elongate metal plates arranged to form a rectangular array, a first opposing pair of the metal plates is longer than a second opposing pair of the metal plates, wherein the length of the first opposing pair of the metal plates is one quarter wavelength of a first electric wave, and the length of the second opposing pair of metal plates is one quarter wavelength of a second electric wave, the first electric wave has a frequency lower than that of the second electric wave.

2. The antenna array of claim 1, wherein the roots of the metal plates are serially connected to a signal feed terminal, and the conductors are connected to a copper tube via a coaxial cable external conductor.

3. The antenna array of claim 1, wherein the metal plates include non-insulated bare plates.

4. The antenna array of claim 1, wherein the metal plates are made of iron or copper.

5. The antenna array of claim 1, further comprising a connecting board to connect roots of the metal plates.

6. The antenna array of claim 1, further comprising a positioning member clipped between top portions of the metal plates.

7. The antenna array of claim 6, wherein the positioning member is made of elastic foam or rubber.

8. A dual band linear antenna array, comprising three elongate metal plates arranged to form an open rectangular array, one of the metal plates is longer than the other two metal plates, wherein the length of the longer metal plate is one quarter wavelength of a first electric wave, and the length of the other two metal plates is one quarter wavelength of a second electric wave, the first electric wave has a frequency lower than that of the second electric wave.

9. The antenna array of claim 8, wherein the roots of the metal plates are serially connected to a signal feed terminal, and the conductors are connected to a copper tube via a coaxial cable external conductor.

10. The antenna array of claim 8, wherein the metal plates include non-insulated bare plates.

11. The antenna array of claim 8, wherein the metal plates are made of iron or copper.

12. The antenna array of claim 8, further comprising a connecting board to connect roots of the metal plates.

13. The antenna array of claim 8, further comprising a positioning member clipped between top portions of the metal plates.

14. The antenna array of claim 13, wherein the positioning member is made of elastic foam or rubber.

* * * * *